US007441411B2

(12) United States Patent
Gleeson et al.

(10) Patent No.: US 7,441,411 B2
(45) Date of Patent: Oct. 28, 2008

(54) METHOD AND APPARATUS TO DETECT ONSET OF COMBUSTOR HARDWARE DAMAGE

(75) Inventors: Eamon Patrick Gleeson, Atlanta, GA (US); Warren James Mick, Altamont, NY (US); George Edward Williams, Niskayuna, NY (US); Fei Han, Clifton Park, NY (US); Shivakumar Srinivasan, Greer, SC (US); Scott Alan Kopcho, Atlanta, GA (US); Ilan Leibu, Marietta, GA (US)

(73) Assignee: General Electric Company, Schenectady, NY (US)

( * ) Notice: Subject to any disclaimer, the term of this patent is extended or adjusted under 35 U.S.C. 154(b) by 651 days.

(21) Appl. No.: 11/229,168

(22) Filed: Sep. 16, 2005

(65) Prior Publication Data

US 2007/0062196 A1 Mar. 22, 2007

(51) Int. Cl.
*F02M 35/00* (2006.01)

(52) U.S. Cl. ..... 60/779; 60/39.091

(58) Field of Classification Search ..... 60/725, 60/39.091, 772, 779, 803, 39.281, 794; 431/114, 431/1, 13; 181/206; 700/274
See application file for complete search history.

(56) References Cited

U.S. PATENT DOCUMENTS

| | | | | |
|---|---|---|---|---|
| 4,644,783 | A * | 2/1987 | Roberts et al. | 73/114.07 |
| 6,461,144 | B1 * | 10/2002 | Gutmark et al. | 431/2 |
| 6,591,225 | B1 | 7/2003 | Adelman et al. | |
| 6,634,457 | B2 * | 10/2003 | Paschereit et al. | 181/229 |
| 2005/0144955 | A1 * | 7/2005 | Handelsman et al. | 60/772 |

* cited by examiner

*Primary Examiner*—Devon Kramer
*Assistant Examiner*—Vikansha Dwivedi
(74) *Attorney, Agent, or Firm*—Armstrong Teasdale LLP

(57) ABSTRACT

A method for determining when a combustor is experiencing hardware damage includes sensing acoustic vibrations of a plurality of combustor cans, determining a center frequency for each acoustic tone of the sensed acoustic vibrations within a predetermined frequency range, and indicating an alarm when a center frequency of one or more of the combustor cans changes in a different manner compared to a representative center frequency of the plurality of combustor cans.

20 Claims, 9 Drawing Sheets

136

| Can | Frequency | Delta |
|---|---|---|
| Freq1 | 1026.64 | 6.26 |
| Freq2 | 1039.16 | 18.78 |
| Freq3 | 1020.38 | 0 |
| Freq4 | 1020.38 | 0 |
| Freq5 | 1020.38 | 0 |
| Freq6 | 995.34 | -25.04 |
| Freq7 | 1032.9 | 12.52 |
| Freq8 | 1020.38 | 0 |
| Freq9 | 1014.12 | -6.26 |
| Freq10 | 1007.86 | -12.52 |
| Freq11 | 1014.12 | -6.26 |
| Freq12 | 1032.9 | 12.52 |
| Freq13 | 1014.12 | -6.26 |
| Freq14 | 1020.38 | 0 |
| Median | 1020.38 | 0 |

*Fig. 4*

METHOD AND APPARATUS TO DETECT ONSET OF COMBUSTOR HARDWARE DAMAGE

BACKGROUND OF THE INVENTION

This invention relates generally to a system for evaluating the performance of a combustor power plant and, more particularly, to a method and apparatus for detecting the onset of combustor hardware damage and to power plants incorporating such methods and systems.

The profitable operation of combined-cycle power plants is a difficult and complex problem to evaluate and optimize. The performance of modern combined-cycle power plants is strongly influenced by various factors including environmental factors (e.g., ambient temperature and pressure) and operational factors (e.g., power production levels and cogeneration steam load requirements).

In some cases, issues develop with respect to particular combustor cans in a power plant that result in undesirable operating conditions or even damage to gas turbine combustion systems. For example, particular cans can have mechanical problems relating to fuel nozzles, liners, transient pieces, transient piece sides, radial seals, or impingement sleeves. These problems can lead to damage, inefficiencies, or blow outs due to combustion hardware damage.

BRIEF DESCRIPTION OF THE INVENTION

In one aspect, the present invention therefore provides a method for determining when a combustor is experiencing hardware damage. The method includes sensing acoustic vibrations of a plurality of combustor cans, determining a center frequency for each acoustic tone of the sensed acoustic vibrations within a predetermined frequency range, and indicating an alarm when a center frequency of one or more of the combustor cans changes in a different manner compared to a representative center frequency of the plurality of combustor cans.

In another aspect, the present invention provides a system for determining when a combustor is experiencing hardware damage. The system includes a plurality of sensors configured to sense acoustic vibrations of a plurality of combustor cans, a processor configured to determine a center frequency for each acoustic tone of the sensed acoustic vibrations within a predetermined frequency range, and an alarm responsive to the processor. The processor is configured to activate the alarm when a center frequency of one or more of the combustor cans changes in a different manner compared to a representative center frequency of the plurality of combustor cans.

In yet another aspect, the present invention provides a power generating plant that includes a plurality of combustion cans, a plurality of sensors configured to sense acoustic vibrations of a plurality of combustor cans, a processor configured to determine a center frequency for each acoustic tone of the sensed acoustic vibrations within a predetermined frequency range, and an alarm responsive to the processor. The processor is configured to activate the alarm when a center frequency of one or more of the combustor cans changes in a different manner compared to a representative center frequency of the plurality of combustor cans.

It will thus be seen that configurations of the present invention are useful to provide advanced warning and protection for gas turbine combustion systems. For example, configurations of the present invention can be used to warn operators that a particular combustion can has issues revealed by an unusual combustion temperature and resulting "center" frequency that must be addressed by corrective action. Temperature differences determined by configurations of the present invention (or other data indicative of such temperature differences) can also be input to a control system algorithm to actively control a fuel split to increase blow out margin when a machine is at risk of a trip from a lean blow out resulting from combustion hardware damage.

BRIEF DESCRIPTION OF THE DRAWINGS

FIG. 4 is a table representative of frequencies and frequency deviations of individual combustor cans at a particular time in a one configuration of the present invention.

DETAILED DESCRIPTION OF THE INVENTION

Some configurations of the present invention provide a method for determining when a combustor is starting to develop hardware damage. Also, an alarm is generated to indicate that corrective action is required. Thus, one technical effect of the present invention is the indication of an alarm to indicate the need for corrective action when a combustor starts to become damaged. To make this determination, the frequency of one of the acoustic modes (i.e., a standing wave generated at one or more resonance frequencies of combustor) occurring inside the combustion chamber is measured. The acoustic mode travels in a direction transverse to an axis of the combustion liner. The frequency of the acoustic mode is dependent upon combustor dimensions and the speed of sound inside the combustion chamber, the latter in turn being dependent upon the gas inside the combustion chamber. The speed of sound of the gas may be determined from the temperature and properties of the gas.

Figure 1:
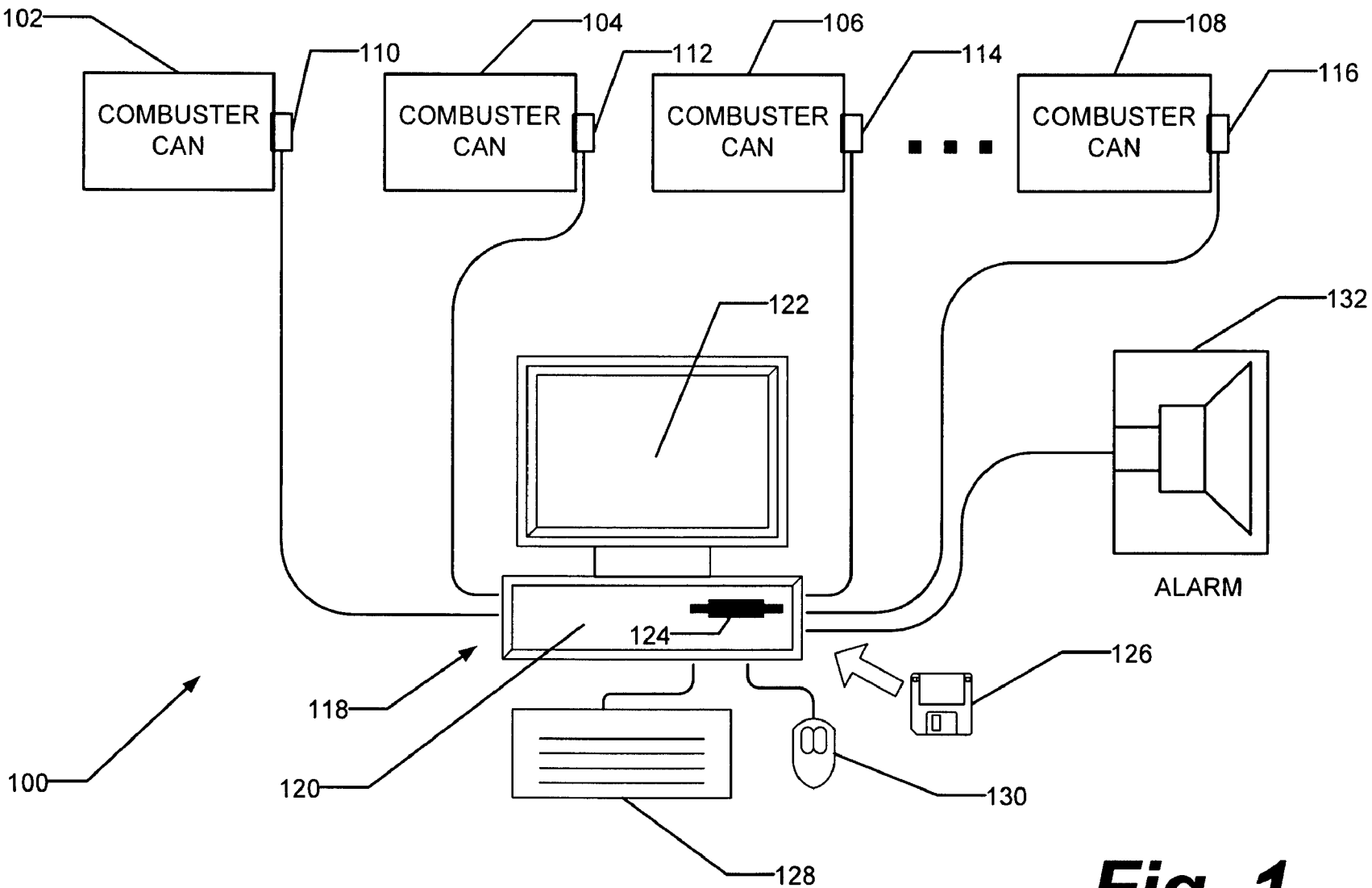
FIG. 1 is schematic block diagram representative of various configurations of the present invention.

For example, and referring to FIG. 1, a power plant 100 has a plurality of combustor cans such as cans 102, 104, 106, and 108. Cans 102, 104, 106, 108 are monitored using at least a corresponding plurality of sensors 110, 112, 114, 116, respectively. Although only four cans and four sensors are shown in FIG. 1, it will be understood that the invention is not limited to configurations with four cans and four sensors. Rather, configurations can comprise any number of cans greater than two and at least a corresponding plurality of sensors. (Configurations with only one or two cans do not provide meaningful means and/or medians for statistical comparisons. Also, the invention does not require that every combustion can be monitored, although, of course, the advantages of the present invention will not accrue with respect to the non-monitored cans.) In some configurations, sensors 110, 112, 114 and 116 are dynamic pressure sensors configured to sense acoustic vibrations from corresponding cans 102, 104, 106, and 108. Data from sensors 110, 112, 114, and 116 is provided (in an appropriate form) to a computing system 118, which can comprise a general purpose computer or PC, a special purpose processor or operator console, etc. In some configurations, computing system 118 comprises a processor 120 with the usual memory, hard drive, etc., as well as input and output ports, a display 122, a floppy diskette, CD or DVD drive 124 that is configured to read (and, in various configurations) write on removable media 126, a keyboard 128 for operator input, and a pointing device 130 for the convenience of the operator. Depending upon data received from sensors 110, 112, 114, and 116 and in a manned described in detail below, an alarm 132 may be indicated and/or an appropriate warning displayed on display 122. Alarm 132 can be any type of signaling device, and, in some configurations, comprises one or more audible annunciators and/or warning lights, such as flashing strobe lights. Alarm 132 is responsive to processor 120, and processor 120 is configured to activate the alarm when a center frequency of one or more of combustor cans 102, 104, 106, and/or 108 changes in a different manner compared to a representative center frequency of the plurality of combustor cans 102, 104, 106, and 108. In some configurations, the representative center frequency is a median center frequency of the acoustic tones within a predetermined frequency range.

Some configurations of the present invention determine temperature inside a combustion can 102 chamber using a measurement of resonant frequency of the chamber in combination with knowledge of the combustor dimensions and gas properties. Thus, in some configurations of the present invention, alarm 132 is indicated as damage begins, before significant damage has occurred. When the damage begins, an automated warning signal is indicated so that either manual or automated corrective action, or both, can be taken to correct the problem on the spot and prevent a worsening of the condition. More particularly, from equation 1 or from equation 2, the resonant frequency of a combustor is proportional to the square root of the flame temperature within the combustion liner.

$$f = 1.841\frac{\sqrt{1.3*286*T_{flame}}}{\pi\bar{D}} \quad \text{Equation 1}$$

or $$f = \text{constant}\times\sqrt{T_{flame}} \quad \text{Equation 2}$$

Hence frequency is proportional to the square root of flame temperature within the combustion liner.

Figure 2:
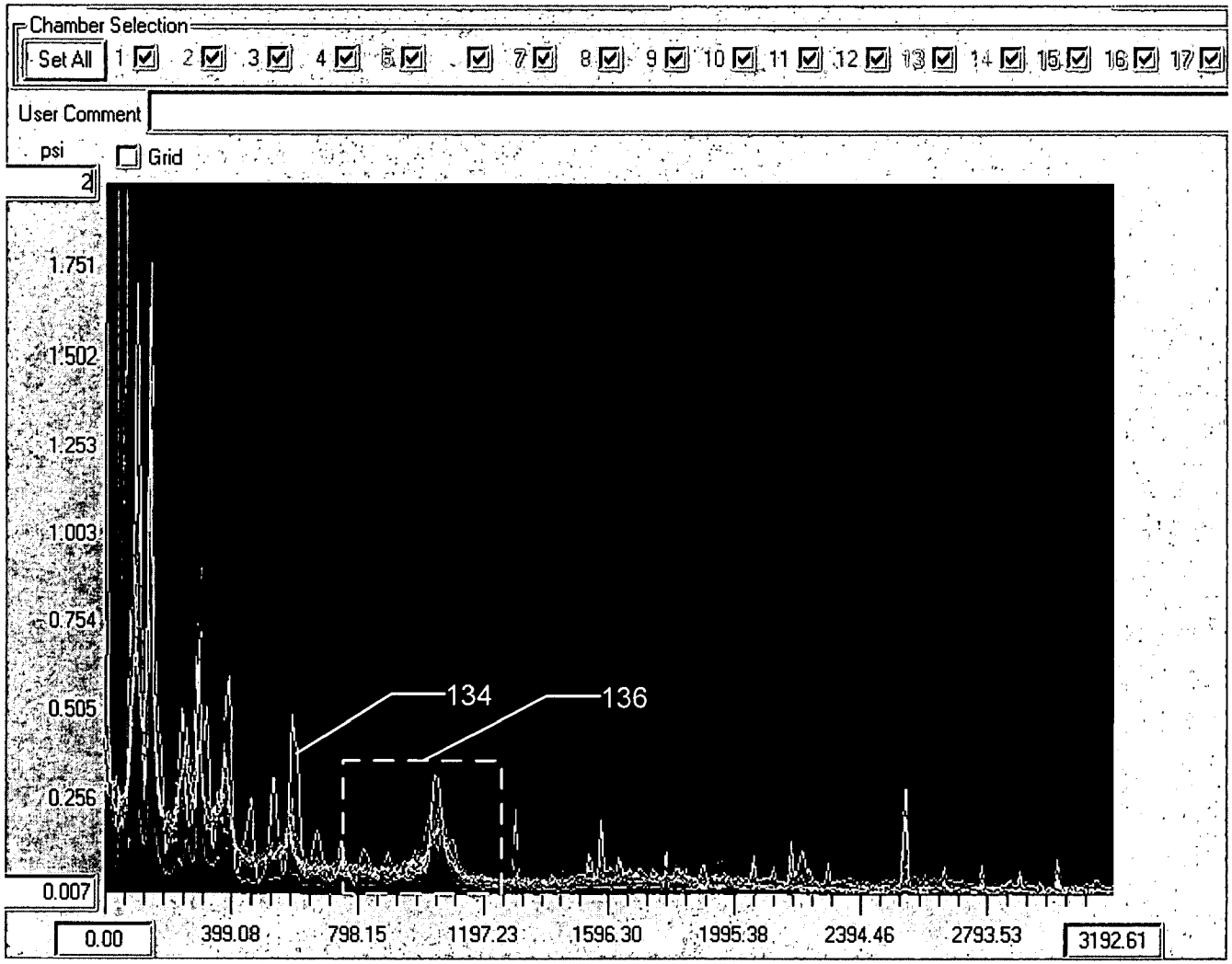
FIG. 2 is an image of a computer display showing spectra of a plurality of operating combustion cans.
Figure 3:
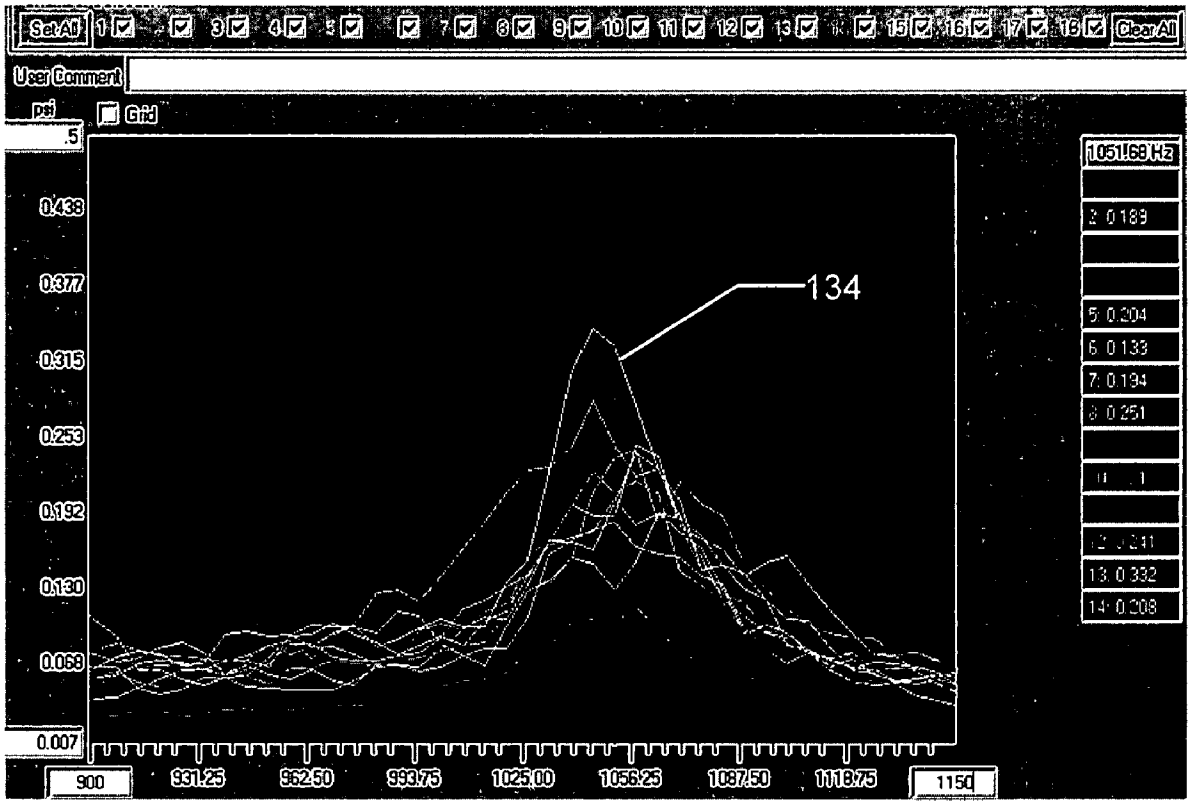
FIG. 3 is an image of a computer display showing a portion of the spectra of FIG. 2 in greater detail.

Thus, in some configurations and referring to FIGS. 2 and 3, a fast Fourier transform (FFT) is taken of an acoustic tone sensed from each can 102, 104, 106, and 108. For example, one such FFT spectrum is indicated by 134. The acoustic tone is sensed, for example, by a piezoelectric pressure sensor 110, 112, 114, or 116 or any other suitable pressure and/or sound sensor. A center frequency for each acoustic tone between, for example, 900 Hz (FT_low_freq) and 1100 Hz (FT_high_freq) is determined for each combustion can 102, 104, 106, 108. A representative center frequency such as a mean or a median center frequency is then determined from these center frequencies as shown at 136. The median frequency is used in some configurations because it represents an approximately average behavior for each can 102, 104, 106, 108, while avoiding bias that might be introduced by anomalous readings (such as those resulting from bad sensors 110, 112, 114, 116, unusual operating conditions, etc.) from any of combustion cans 102, 104, 106, or 108. Changes that take place in the operational state of a combustor 102, 104, 106, or 108 will be reflected by changes in this median frequency. However, if an event occurs and is limited to a single can 102, 104, 106 or 108, this event will not be reflected in the median frequency. The values of FT_low_freq (900 Hz) and FT_high_freq (1100 Hz) are given as a predetermined frequency range by way of example only. Other ranges may include the 1000 Hz frequency, or may be different from values recited herein. More particularly, the predetermined frequency range can be selected in accordance with combustor geometry.

Figure 5:
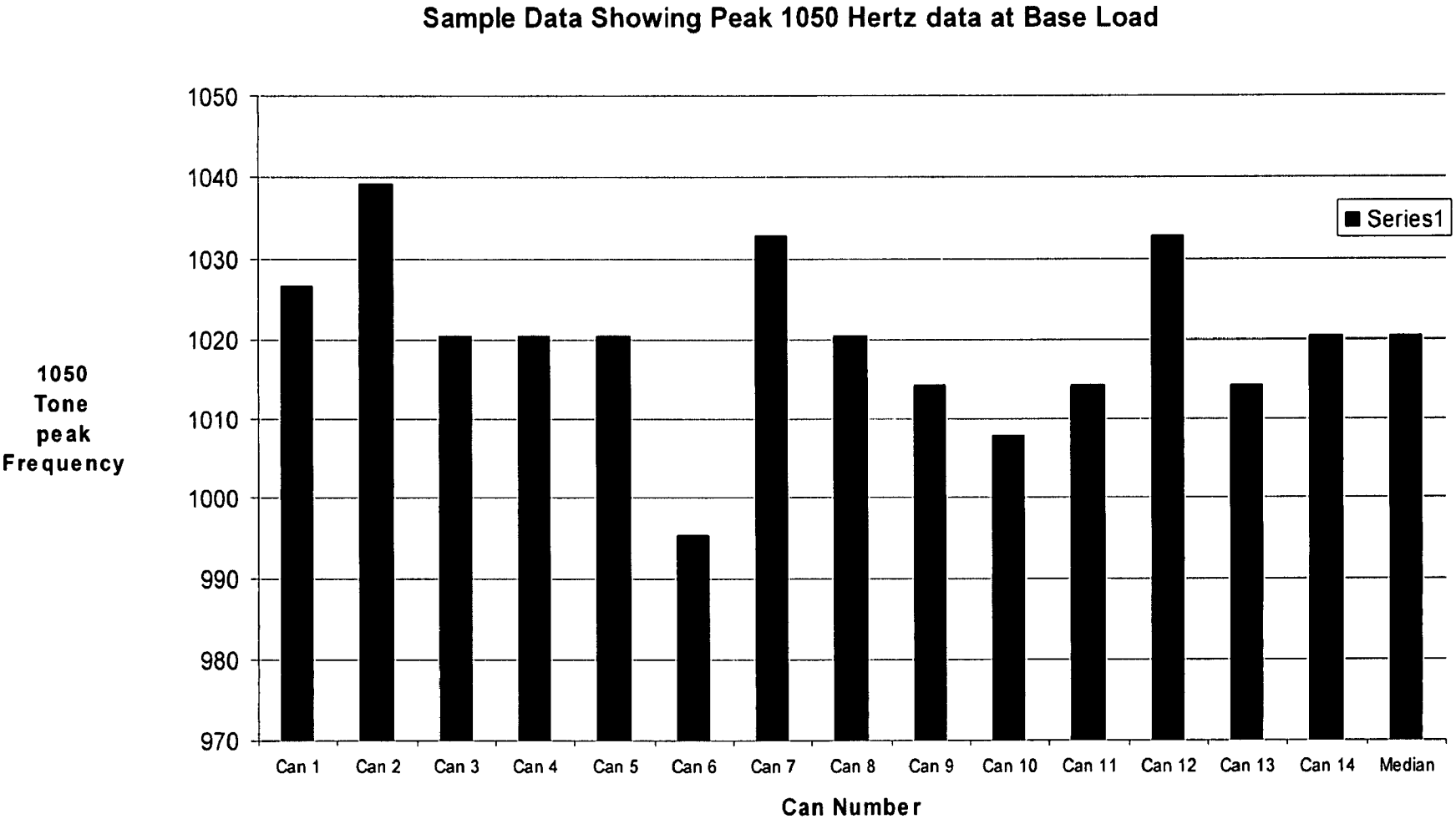
FIG. 5 is a bar graph of the frequencies shown in FIG. 4.
Figure 6:
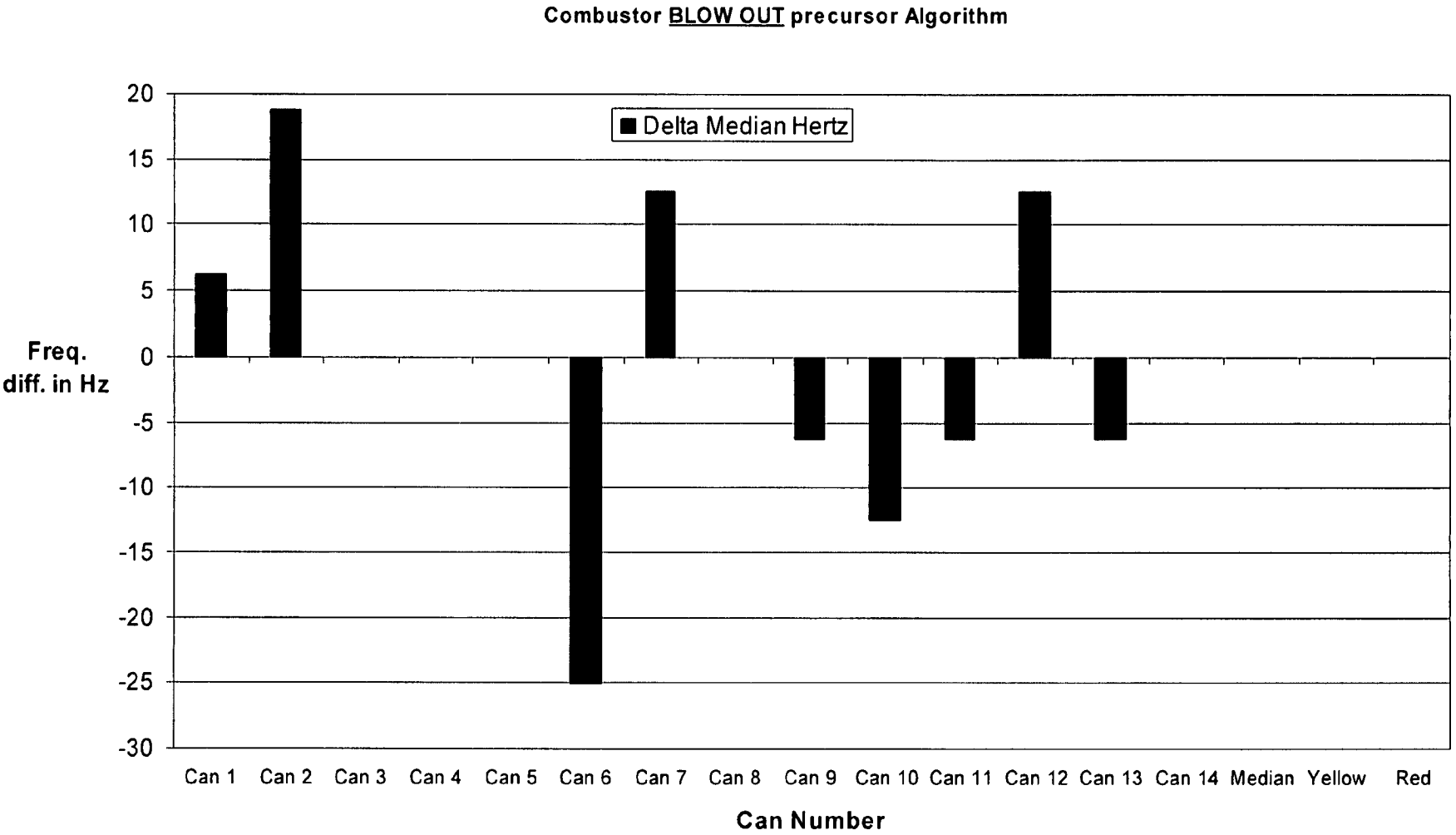
FIG. 6 is a bar graph of the frequency deviations shown in FIG. 4.

A representative list of tone frequencies and differences for a system having fourteen combustion cans is shown in FIG. 4, along with the median frequency. (The example in FIG. 4 is not the same as shown in FIGS. 2 and 3.) In some configurations and referring to FIGS. 4 to 7, a difference ("Delta") is determined between the frequency of each can and the determined median frequency. A can having a frequency greater than the median frequency is presumed to be running hotter than a can at the median frequency. For example, in FIGS. 4 to 7, each can is given a number from 1 to 14, and its determined tone frequency from the FFT within the selected range FT_low_freq and FT_high_freq is denoted by FreqN, where N is the can number. Can number 1 is running 6.28 Hz higher than the median frequency, so this difference is an indication that can number 1 is running hotter than the median. If the can frequency is lower than the median frequency, as in the case of can number 6, that can is running cooler than the median. For this example, a table of can frequencies and deltas is given in FIG. 4, the tone frequency peak near 1050 Hz (i.e., with in the selected range) is shown in FIG. 5, and the deltas are shown in FIG. 6.

The magnitude of the difference is proportional to the square root of the temperature difference of each can relative to the median frequency can temperature, as indicated by equation 2. As the combustor load is changed, the peak frequency of each can also changes, but the difference relative to the median frequency can should remain the same, and thus at approximately the same relative temperature difference to the median frequency can. A drift away from the median can frequency by any can is assumed to indicate that something has changed in the can, and such a change may be indicative of combustor hardware damage. For example and referring to FIGS. 4 to 6, a drift greater than (for example) 10 Hz around the median frequency may be used to signal a high or low temperature alarm, depending upon the sign of delta, while a drift greater than (for example) 20 Hz may be used to signal a very high or very low temperature alarm. Thus, a high temperature alarm is indicated in some configurations when a frequency of a combustor can drifts higher (by at least a predetermined amount, in many such configurations) relative to the representative center frequency of the plurality of combustor cans. When the frequency drifts lower, a low temperature alarm is indicated.

Example: Decrease in relative temperature of combustor.

In FIG. 4, can number 1 is running 6 Hz higher than the median for a number of weeks. Afterwards, this difference gradually slips until can number 1 runs at 5 Hz lower than the median frequency. This change in frequency indicates that something has happened to the hardware in can number 1 to make it run at a lower temperature relative to the can having the median frequency. In this case, the change in frequency could thus also be an indication of combustion hardware damage, for example, damage to a fuel nozzle that would result in decreased fuel flow and hence a reduction in the can's temperature. Alternatively, the temperature slippage could result from damage to the combustor liner or transition piece, which would result in increased airflow to the heat end of the combustor and hence a decrease in the temperature of the combustor relative to the can having median frequency.

Example: Increase in relative temperature of combustor.

Suppose, as in FIG. 4, can number 1 is running 6 Hz higher than the median for a number of weeks, and then this difference in frequency starts to gradually rise until can 1 is now running at a frequency that is +15 Hz relative to the median. This increase is an indication that something has happened with the hardware in this can to make it run at a relatively higher temperature. This could be an indication of combustion hardware damage, such as damage to a fuel nozzle, resulting in increased fuel flow and hence an increase in that can's temperature. Or, alternatively, it could result from damage to the combustor liner or transition piece, which resulted in decrease airflow to the heat end of the combustor and hence an increase in the relative temperature of the combustor.

Figure 7A:
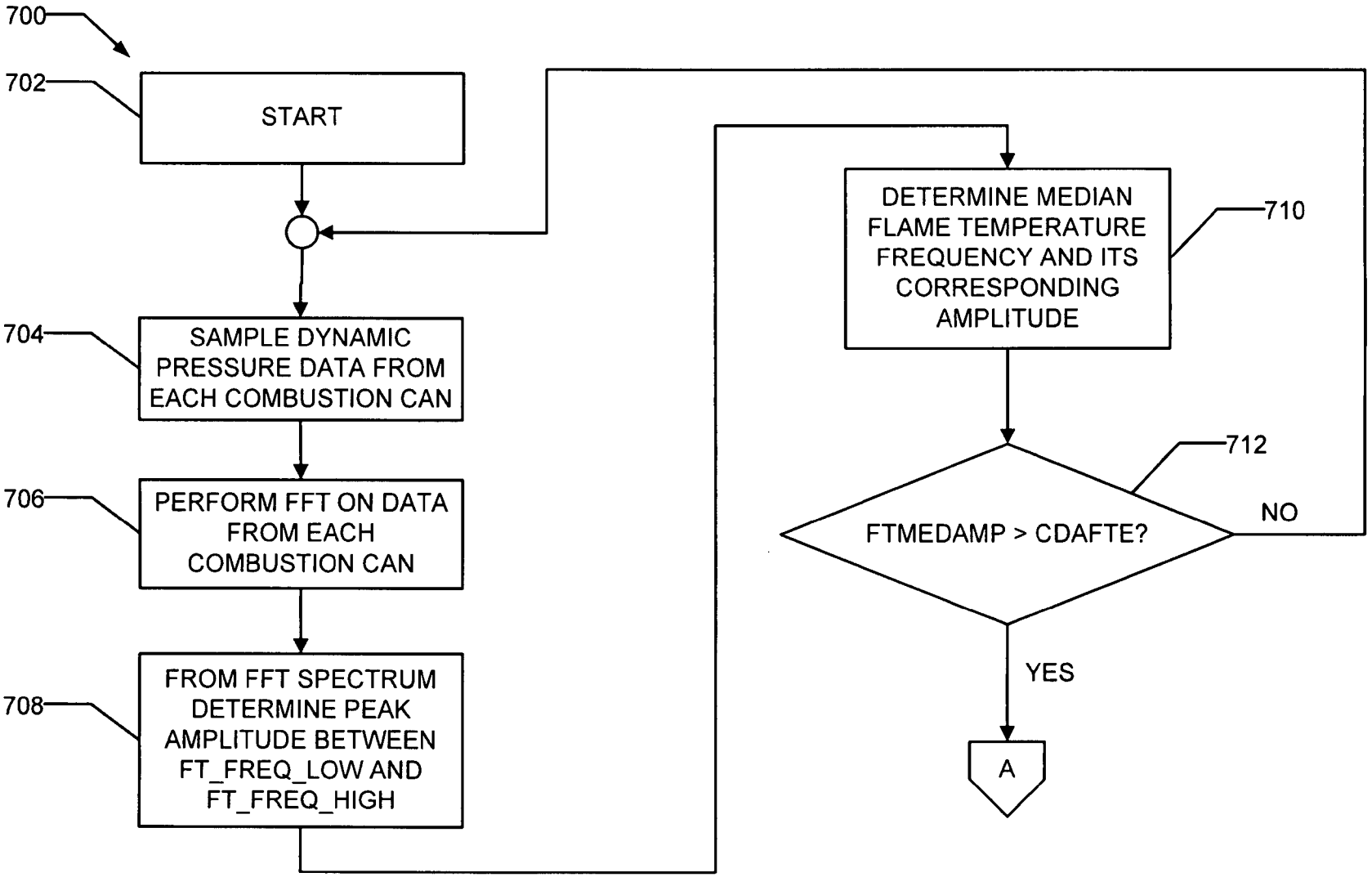
FIG. 7 is a flow chart representative of some configurations of the present invention.
Figure 7B:
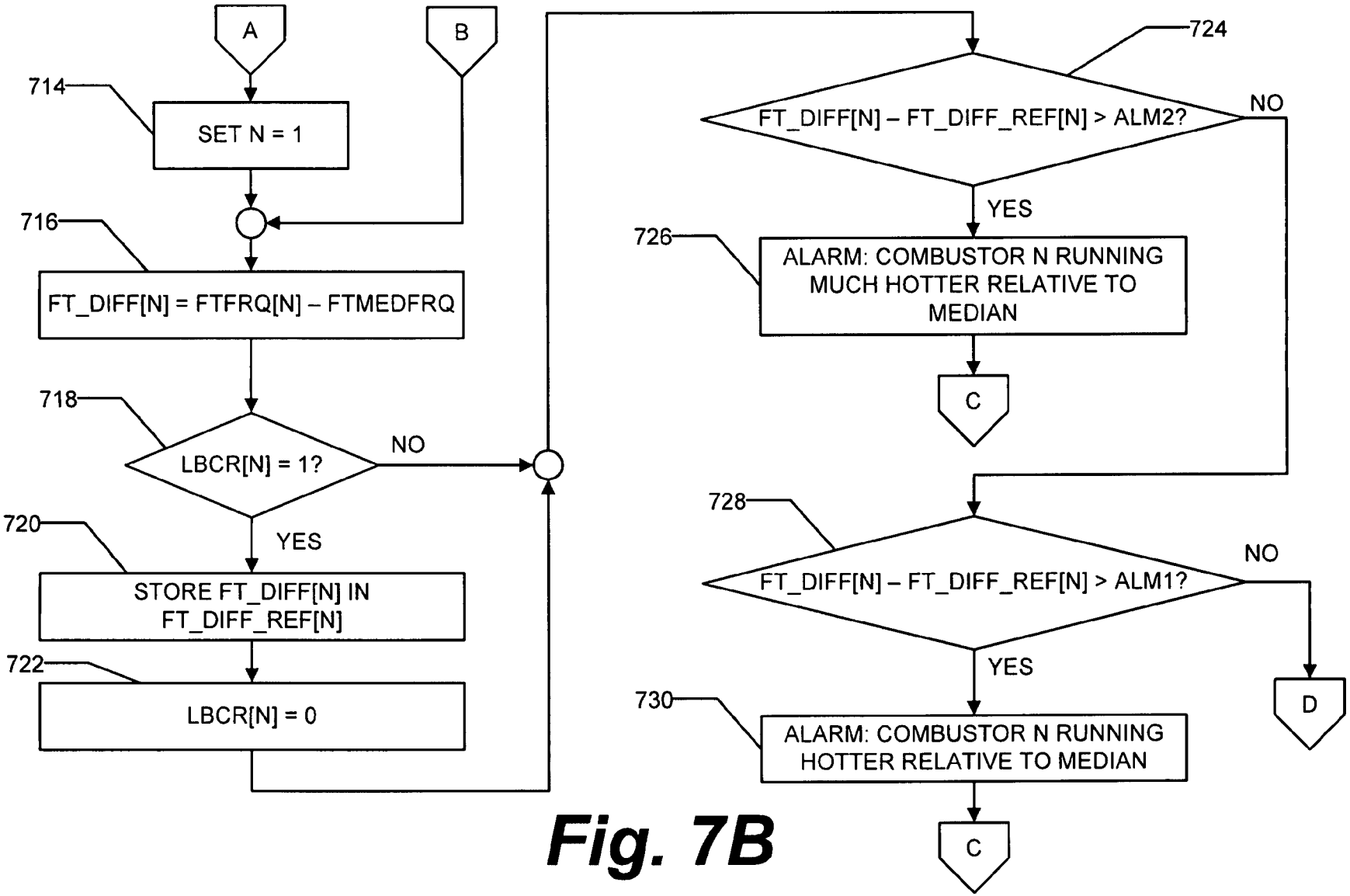
Figure 7C:
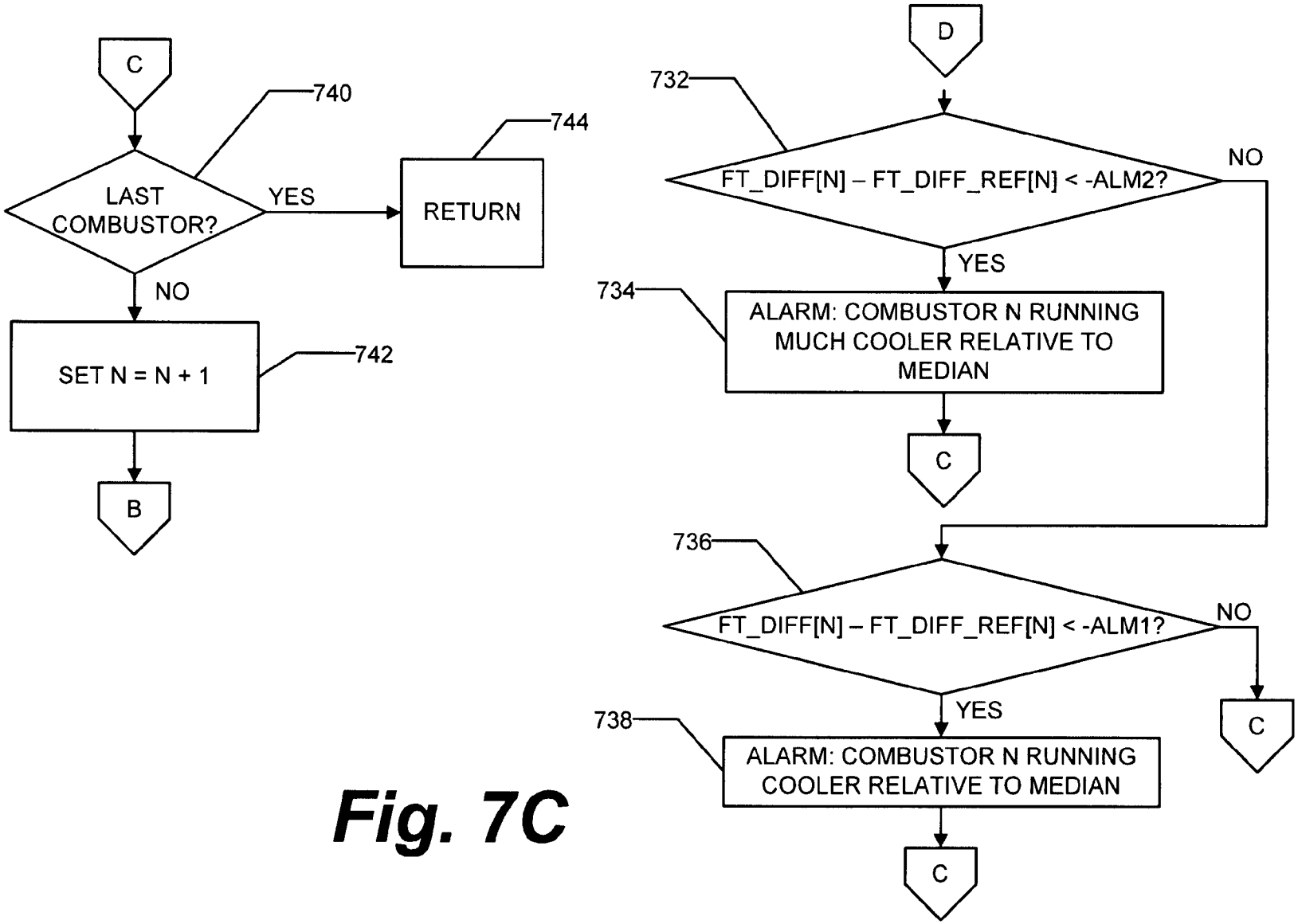

Referring to flow chart 700 of FIG. 7, a technical effect of the present invention is achieved in some configurations of the present invention by processor 120 initializing a program at 702. This program can be supplied on a hard drive or other memory of processor 120 or as instructions recorded on a machine-readable medium 126, for example. Sensors such as 110, 112, 106, and 108 of FIG. 1 sense acoustic vibrations of a plurality of combustor cans such as cans 102, 104, 106, and 108, resulting in dynamic pressure data being sampled 704 from each combustion can by processor 120. An FFT is performed 706 on the sampled data from each of the combustion cans to determine frequency spectra for the sampled plurality of combustor cans. Next, a peak frequency is determined for each acoustic tone of the sensed acoustic vibrations within a frequency range between two preselected frequencies, FT_freq_low and FT_freq high. (The peak frequency is taken as a "center" frequency.) A representative center frequency of the plurality of combustor cans, for example, a median "flame temperature" frequency (i.e., a median of the center frequencies within the predetermined frequency range) is determined at 710, as is its corresponding amplitude FTmedAMP, in some configurations of the present invention. If FTmedAMP is not greater than a predetermined minimum value CDAFTE (for example, 0.1 PSI) at 812, then it is assumed that the flame temperature acoustic tone is not present. Instead, execution resumes at 704 to obtain new samples of dynamic pressure data from each can. Note that FT_freq_low, FT_freq_high, and CDAFTE in some configurations are user configurable constants that can be varied empirically or otherwise for best results in a particular installation.

If FTmedAMP is greater than a predetermined minimum value CDAFTE (for example, 0.1 PSI) at 712, then it is assumed that a flame temperature acoustic tone is present, and execution resumes by setting 714 a loop variable (N in this example) so that each monitored can is checked. Next, a current difference frequency FT_DIFF[N] is determined 716 for can N by setting FT_DIFF[N] to FTFRQ[N], i.e., the current "center" or peak frequency determined at 708 for can N, minus the current median frequency found at 710, namely, FTMEDFRQ.

In some configurations of the present invention, a variable LBCR[N] can be set at any time by a user input button or by use of keyboard or mouse commands to indicate that a baseline for can N is to be reset relative to the current median frequency FTMEDFRQ. Thus, if LBCR[N] is set at 718, the difference FT_DIFF[N] is stored 720 in variable FT_DIFF_REF[N] and LBCR[N] is reset 722 and ready to be set again by operator command.

If LBCR[N] is not set at 718, or after the branch 720, 722 is executed, the difference FT_DIFF[N]−FT_DIFF_NREF[N] is determined at 724. If this difference is greater than a predetermined allowable deviation ALM2 from the baseline for "alarm2," then an alarm is indicated 726 for combustor can N running much hotter relative to the combustor can represented by the median frequency. Execution then continues by checking 740 whether the can represented by N is the last combustor can, and if so, the function returns at 744. (In some configurations, the function is immediately re-executed starting from 702.) Otherwise, can counter N is incremented at 742 and execution resumes at 716 to check conditions at the next can.

If the test fails at 724, a test 728 is performed to determine whether the same difference checked at 724 is greater than a predetermined allowable deviation ALM1 from the baseline for "alarm1." If so, then an alarm is indicated at 730 for combustor can N running hotter (as opposed to "much hotter") relative to median. If the alarm is indicated at 730, execution continues at 740 as above. Otherwise, test 728 failed, and the same difference checked at 724 is checked at 732 to determine whether the difference is less than a negative value, −ALM2. If so, then an alarm is indicated at 734 for combustor can N running much cooler relative to median. If the alarm at 734 is indicated, execution continues at 740. Otherwise, another check is made of the same difference at 736 to determine whether this difference is less than a negative value, −ALM1. If so, then an alarm is indicated at 738 for combustor can N running cooler (as opposed to "much cooler") relative to median. In this case, execution continues at 740 regardless of whether the alarm is indicated at 738. Thus, in some configurations of the present invention, an alarm is indicated when a center frequency of one or more combustor cans changes in a different manner compared to a representative center (e.g., median center) frequency of the plurality of combustor cans. This alarm indication, in some configurations, comprises indicating one of a plurality of alarms 726, 730, 734, 738 depending upon whether the center frequency of the one or more combustor cans changes in a manner indicating a higher temperature or a lower temperature, and upon the magnitude of the temperature difference.

In some configurations of the present invention, ALM1 is a predetermined constant (e.g., 15 Hz) that represents an allowable deviation from baseline for the "hotter" and "cooler" alarms, and ALM2 is a different predetermined constant (e.g., 25 Hz) that represents an allowable deviation from baseline for the "much hotter" and "much cooler" alarms. In some configurations, ALM1 and ALM2 are configurable by a user and can be set for a particular installation based upon either empirical or other information. Although the hot and cool alarms are symmetric in the configuration described herein (i.e., a positive deviation generates a hot alarm and a negative deviation of the same magnitude generates a cool alarm), non-symmetric alarms can be provided as a design choice in some configurations. Moreover, although two different alarms are provided for both hot alarms for cool alarms, any number of alarms indicative of different amounts of deviation can be provided for hot and/or cold alarms. In some configurations, also as a design choice, only hot alarms are checked and indicated, or only cold alarms are checked and indicated. Various combinations of these design choices are also possible in other configurations. Also, in the flow chart of FIG. 7, tests 724, 728, 732, and 736 are arranged in such a manner as to avoid redundant tests and alarms, but other configurations are also possible and various design choices will be evident to one skilled in the art of computer programming. Many of these design choices will ensure that an alarm indicating the highest magnitude of deviation will be indicated for each combustor can Configurations of the present invention are thus useful to provide advanced warning and protection for gas turbine combustion systems. For example, configurations of the present invention can be used to warn operators that a particular combustion can has issues revealed by an unusual combustion temperature and resulting "center" frequency that must be addressed by corrective action. These issues may involve mechanical problems with fuel nozzles, liners, transient pieces, transient piece side or radial seals or impingement sleeves, for example. Temperature differences determined by configurations of the present invention (or other data indicative of such temperature differences) can be input to a control system algorithm such as that disclosed in U.S. Pat. No. 6,591,225 issued Jul. 8, 2003 to Adelman et al. to actively control a fuel split to increase blow out margin when a machine is at risk of a trip from a lean blow out resulting from combustion hardware damage.

While the invention has been described in terms of various specific embodiments, those skilled in the art will recognize that the invention can be practiced with modification within the spirit and scope of the claims.

What is claimed is:

1. A method for determining when a combustor is experiencing hardware damage, said method comprising:

sensing acoustic vibrations of a plurality of combustor cans;

determining a center frequency for each acoustic tone of the sensed acoustic vibrations within a predetermined frequency range;

indicating an alarm when a center frequency of one or more said combustor cans changes in a different manner compared to a representative center frequency of the plurality of combustor cans.

2. A method in accordance with claim 1 wherein the representative center frequency is a median center frequency of the acoustic tones within the predetermined frequency range.

3. A method in accordance with claim 1 wherein the predetermined frequency range is between 900 Hz and 1100 Hz.

4. A method in accordance with claim 1 wherein the predetermined frequency range includes 1000 Hz.

5. A method in accordance with claim 1 wherein said indicating an alarm comprises indicating a high temperature alarm for one of said combustor cans when a frequency of said one of said combustor cans drifts higher relative to the representative center frequency of the plurality of combustor cans.

6. A method in accordance with claim 1 wherein said indicating an alarm comprises indicating a low temperature alarm for one of said combustor cans when a frequency of said one of said combustor cans drifts lower relative to the representative center frequency of the plurality of combustor cans.

7. A method in accordance with claim 1 wherein said determining a center frequency for each acoustic tone of the sensed acoustic vibrations within a predetermined frequency range further comprises sampling dynamic pressure data from the plurality of combustion cans, performing a fast Fourier transform on the sampled dynamic pressure data to determine frequency spectra for the sampled plurality of combustion cans, and determining a peak amplitude of each frequency spectra between two preselected frequencies.

8. A method in accordance with claim 7 further comprising determining a median flame temperature frequency and a corresponding amplitude.

9. A method in accordance with claim 1 wherein said indicating an alarm when a center frequency of one or more said combustor cans changes in a different manner compared to a representative center frequency of the plurality of combustor cans further comprises indicating one of a plurality of alarms depending upon whether the center frequency of said one or more combustor cans changes in a manner indicating a higher temperature or a lower temperature, and depending upon the magnitude of temperature difference.

10. A system for determining when a combustor is experiencing hardware damage, said system comprising:

a plurality of sensors configured to sense acoustic vibrations of a plurality of combustor cans;

a processor configured to determine a center frequency for each acoustic tone of the sensed acoustic vibrations within a predetermined frequency range; and an alarm responsive to the processor, and said processor configured to activate the alarm when a center frequency of one or more said combustor cans changes in a different manner compared to a representative center frequency of the plurality of combustor cans.

11. A system in accordance with claim 10 wherein the representative center frequency is a median center frequency of the acoustic tones within the predetermined frequency range.

12. A system in accordance with claim 10 wherein the predetermined frequency range is between 900 Hz and 1100 Hz.

13. A system in accordance with claim 10 wherein the predetermined frequency range includes 1000 Hz.

14. A system in accordance with claim 10 wherein the alarm is further responsive to the processor to indicate a high temperature alarm for one of said combustor cans when a frequency of said one of said combustor cans drifts higher relative to the representative center frequency of the plurality of combustor cans.

15. A system in accordance with claim 10 wherein the alarm is further responsive to the processor to indicate a low temperature alarm for one of said combustor cans when a frequency of said one of said combustor cans drifts lower relative to the representative center frequency of the plurality of combustor cans.

16. A system in accordance with claim 10 wherein said plurality of sensors are configured to sample dynamic pressure data from the plurality of combustion cans, and said processor is configured to perform a fast Fourier transform on the sampled dynamic pressure data to determine frequency spectra for the sampled plurality of combustion cans, and said processor further configured to determine a peak amplitude of each frequency spectra between two preselected frequencies.

17. A system in accordance with claim 16 wherein said processor further configured to determine a median flame temperature frequency and a corresponding amplitude.

18. A system in accordance with claim 10 wherein said alarm is further responsive to said processor to a plurality of conditions depending upon whether the center frequency changes in a manner indicating a higher temperature or a lower temperature, and depending upon the magnitude of temperature difference.

19. A power generating plant comprising:

a plurality of combustion cans;

a plurality of sensors configured to sense acoustic vibrations of a plurality of combustor cans;

a processor configured to determine a center frequency for each acoustic tone of the sensed acoustic vibrations within a predetermined frequency range; and an alarm responsive to the processor, and said processor configured to activate the alarm when a center frequency of one or more said combustor cans changes in a different manner compared to a representative center frequency of the plurality of combustor cans.

20. A power generating plant in accordance with claim 19 wherein said alarm is further responsive to said processor to a plurality of conditions depending upon whether the center frequency changes in a manner indicating a higher temperature or a lower temperature, and depending upon the magnitude of temperature difference.

* * * * *